US006539299B2

(12) United States Patent
Chatfield et al.

(10) Patent No.: US 6,539,299 B2
(45) Date of Patent: Mar. 25, 2003

(54) APPARATUS AND METHOD FOR CALIBRATING AN ENGINE MANAGEMENT SYSTEM

(75) Inventors: Glen F. Chatfield, Bradfordwoods, PA (US); Roy D. Houston, Bethel Park, PA (US); Philip D. McDowell, Canonsburg, PA (US)

(73) Assignee: Optimum Power Technology, Bridgeville, PA (US)

( * ) Notice: Subject to any disclaimer, the term of this patent is extended or adjusted under 35 U.S.C. 154(b) by 0 days.

(21) Appl. No.: 09/784,336

(22) Filed: Feb. 16, 2001

(65) Prior Publication Data

US 2002/0052682 A1 May 2, 2002

Related U.S. Application Data

(60) Provisional application No. 60/183,380, filed on Feb. 18, 2000.

(51) Int. Cl.[7] ..... F02D 43/04

(52) U.S. Cl. ..... 701/104; 701/115

(58) Field of Search ..... 701/104, 105, 701/114, 115; 123/406.64, 406.65, 480, 486

(56) References Cited

U.S. PATENT DOCUMENTS

| | | | | |
|---|---|---|---|---|
| 4,321,902 A | * | 3/1982 | Stoltman | 123/486 |
| 4,322,800 A | | 3/1982 | Hisegawa et al. | 364/431.05 |
| 4,408,296 A | | 10/1983 | Robbi et al. | 364/569 |
| 4,496,286 A | | 1/1985 | Gagnon | 417/22 |
| 4,551,803 A | | 11/1985 | Hosaka et al. | 364/431.05 |
| 4,676,215 A | | 6/1987 | Blocher et al. | 123/489 |
| 4,677,558 A | | 6/1987 | Bohmler et al. | 364/431.04 |
| 4,703,430 A | | 10/1987 | Amano et al. | 364/431.05 |
| 4,730,256 A | | 3/1988 | Niimi et al. | 364/431.12 |
| 4,955,348 A | | 9/1990 | Budde et al. | 123/478 |
| 5,056,026 A | | 10/1991 | Mitchell et al. | 364/431.03 |
| 5,088,464 A | | 2/1992 | Meaney | 123/478 |
| 5,091,858 A | | 2/1992 | Paielli | 364/431.12 |
| 5,174,263 A | | 12/1992 | Meaney | 123/478 |
| 5,200,900 A | | 4/1993 | Adrain et al. | 364/431.12 |
| 5,268,842 A | | 12/1993 | Marston et al. | 364/431.05 |
| 5,269,275 A | | 12/1993 | Dahlgren | 123/492 |
| 5,284,116 A | | 2/1994 | Richeson, Jr. | 123/425 |
| 5,287,281 A | | 2/1994 | Meaney | 364/431.05 |
| 5,293,317 A | | 3/1994 | Adrain et al. | 364/431.12 |
| 5,444,628 A | | 8/1995 | Meaney et al. | 364/431.05 |
| 5,446,665 A | | 8/1995 | Adrian et al. | 364/431.04 |

(List continued on next page.)

FOREIGN PATENT DOCUMENTS

| | | | |
|---|---|---|---|
| EP | 0474493 | 3/1992 | G05B/19/04 |
| GB | 2076188 | 11/1981 | G06F/9/06 |
| WO | WO 9209957 | 6/1992 | G06F/15/20 |
| WO | WO 9936839 | 7/1999 | G05B/15/00 |

*Primary Examiner*—Andrew M. Dolinar
(74) *Attorney, Agent, or Firm*—Richard W. James; Scott Anchell

(57) ABSTRACT

A method and control apparatus for an internal combustion engine that allows an operator to calibrate engine performance relative to an engine operating characteristic. The control apparatus comprises a base engine control map that correlates values of the characteristic with values of a base engine control, a trim control map that correlates the values of the characteristic with values of a trim control, an engine control unit that obtains from the base engine control and trim control maps the respective base engine control and trim control values that are based on the characteristic value, and a panel that is operatively coupled with the engine control unit and includes a first switch regulating a trim signal supplied to the engine control unit. The trim control map is separated from the base control map. The engine control unit calculates an engine operating control value based on the obtained values. The calculated engine operating control value is supplied to the internal combustion engine to vary the engine performance. The first switch is adapted to be manipulated by the operator. And the trim signal causes the engine control unit to modify the trim control values in the trim control map.

38 Claims, 5 Drawing Sheets

U.S. PATENT DOCUMENTS

| | | | | |
|---|---|---|---|---|
| 5,450,828 | A | 9/1995 | Sakamoto et al. | 123/339.11 |
| 5,523,948 | A | 6/1996 | Adrain | 364/431.01 |
| 5,535,620 | A | 7/1996 | Nichols | 73/118.1 |
| 5,542,393 | A | 8/1996 | Katoh et al. | 123/491 |
| 5,572,978 | A | 11/1996 | Ogawa | 123/491 |
| 5,582,149 | A | 12/1996 | Kanno | 123/413 |
| 5,608,632 | A | 3/1997 | White | 364/431.051 |
| 5,701,871 | A | 12/1997 | Munakata et al. | 123/491 |
| 5,749,346 | A | 5/1998 | Halvorson et al. | 123/486 |
| 5,769,051 | A | 6/1998 | Bayron et al. | 123/335 |
| 5,778,857 | A | 7/1998 | Nakamura et al. | 123/425 |
| 5,803,043 | A | 9/1998 | Bayron et al. | 123/335 |
| 5,806,013 | A | 9/1998 | Paielli | 701/106 |
| 5,829,410 | A | 11/1998 | Hirose | 123/421 |
| 5,908,463 | A | 6/1999 | Akazaki et al. | 701/104 |
| 5,938,716 | A | 8/1999 | Shutty et al. | 701/115 |
| 6,039,012 | A | 3/2000 | Motoyama | 123/65 PE |
| 6,041,279 | A | 3/2000 | Maki et al. | 701/104 |
| 6,067,965 | A | 5/2000 | Trumpy et al. | 123/480 |
| 6,098,012 | A | 8/2000 | Stander et al. | 701/104 |
| 6,098,591 | A | 8/2000 | Iwata | 123/339.11 |
| 6,142,123 | A | 11/2000 | Galasso et al. | 123/486 |
| 6,151,548 | A | 11/2000 | Kamihira et al. | 701/102 |
| 6,170,463 | B1 | 1/2001 | Koerner | 123/406.2 |
| 6,175,772 | B1 | 1/2001 | Kamiya et al. | 700/31 |

* cited by examiner

Trim Operation

APPARATUS AND METHOD FOR CALIBRATING AN ENGINE MANAGEMENT SYSTEM

CROSS REFERENCE TO CO-PENDING APPLICATIONS

This application claims the benefit of the earlier filing date of U.S. Provisional Application No. 60/183,380, filed Feb. 18, 2000, the disclosure of which is incorporated by reference herein in its entirety.

FIELD OF THE INVENTION

The present disclosure is directed to providing an apparatus and a method to calibrate the operation of an engine. In particular, this disclosure is directed to enabling the operator to calibrate the engine operation, either while the engine is not running or while operating in its intended environment, by changing trim control values, which represent modifications to base engine control values that are based on an engine control map. More particularly, this disclosure is directed to enabling a recreational vehicle rider to generate trim control maps for calibrating base engine control maps, e.g., such as for ignition timing and fuel delivery, while riding or driving the vehicle.

It is believed that the performance of an internal combustion engine is dependent on a number of factors including the operating cycle (e.g., two-stroke, four-stroke, Otto, diesel, or Wankel), the number and design of combustion chambers, the selection and control of ignition and fuel delivery systems, and the ambient conditions in which the engine operates.

Examples of design choices for a combustion chamber are believed to include choosing a compression ratio and choosing the numbers of intake and exhaust valves associated with each chamber. In general, it is believed that these choices cannot be changed so as to calibrate engine operation after the engine has been built.

With regard to ignition systems, breaker point systems and electronic ignition systems are known. It is believed that these known systems provide spark timing based on an operating characteristic of the engine, e.g., speed of rotation and load. In the case of breaker point systems, it is believed that engine speed is frequently detected mechanically using centrifugally displaced weights, and that intake manifold vacuum is commonly used to detect engine load. In the case of electronic ignition systems, it is believed that engine speed is generally detected with an angular motion sensor associated with rotation of the crankshaft, and that engine load is frequently detected, for example, by the output of a throttle position sensor. In each case, spark timing is believed to be fixed according to these known systems for a given operating state of the engine.

With regard to fuel delivery systems, carburetors and fuel injection systems are known. It is believed that these known systems supply a quantity of fuel, e.g., gasoline, that is based on the amount of air being admitted to the engine, i.e., in accordance with the position of the throttle as set by the operator. In the case of carburetors, it is believed that fuel is delivered by a system of orifices, known as "jets." As examples of carburetor operation, it is believed that an idle jet may supply fuel downstream of the throttle valve at engine idling speeds, and that fuel delivery may be boosted by an accelerator pump to facilitate rapid increases in engine speed. It is believed that most carburetors must be disassembled and different size jets or pumps installed to modify the amount of fuel delivery. However, this is a laborious process that, it is believed, that most often, can only be done while the engine is not running.

It is believed that known fuel injection systems, which can be operated electronically, spray a precisely metered amount of fuel into the intake system or directly into the combustion cylinder. The fuel quantity is believed to be determined by a controller based on the state of the engine and a data table known as a "map" or "look-up table." It is believed that the map includes a collection of possible values or "setpoints" for each of at least one independent variable (i.e., a characteristic of the state of the engine), which can be measured by a sensor connected to the controller, and a collection of corresponding control values, for a dependent variable control function, e.g., fuel quantity.

Conventionally, it is believed that maps are developed by the engine manufacturer and permanently set in an engine control unit at the factory. Currently, for on-road vehicles, this is believed to be legally required in order to meet emissions regulations. However, it is believed that even when it is not legally required, the manufacturers prevent engine operators from modifying the maps for a variety of reasons such as the manufacturers believe that their maps provide the best engine performance, the manufacturers are afraid that an engine operator might damage the engine by specifying inappropriate control values, or the manufacturers assume that an engine operator might not have sufficient skill to properly modify a map. However, it is believed that the manufacturers have "optimized" their maps to perform best under a set of conditions that they specify. In most cases, it is believed that these conditions do not match the conditions in which the engine is operated. Consequently, stock maps are believed to limit, rather than optimize, an engine's performance.

It is further believed that ambient conditions such as air temperature, altitude, and barometric pressure affect engine performance. It is believed that these conditions generally impact the entire operating range of the engine. In the case of fuel injection, it is believed to be known to compensation for these conditions by calculating an adjustment for every operating state of the engine.

Thus, engine performance is believed to be substantially dependent on how combustion is accomplished in the ambient conditions. The stoichiometric ratio of air to gasoline is 14.7:1. However, it is believed that ratios from about 10:1 to about 20:1 will combust, and that it is often desirable to adjust the air-fuel ratio to achieve specific engine performance (e.g., a certain level of power output, better fuel economy, or reduced emissions). Similarly, it is also believed to be desirable to adjust ignition timing, commonly measured in degrees of crank rotation before a piston reaches top-dead-center of the compression stroke, to achieve specific engine performance (e.g., lowest fuel consumption or reduced emissions).

It is believed to be a disadvantage of known ignition timing systems and fuel delivery systems that engine operation is constrained by the fixed controls established by the suppliers of these systems. It is also believed to be a disadvantage that any possible adjustments to these known systems requires a technician to reconfigure one or more of the system components, or to disassemble the system, install substitute components, and reassemble the system. Therefore, it is further believed to be a disadvantage of these known systems that neither the effectiveness nor the sufficiency of these adjustments can be determined while continuously operating the engine in its intended environment. And it is yet further believed to be a disadvantage of these known systems that the effect of these adjustments cannot be directly compared.

There is believed to be a need to overcome these disadvantages of known ignition and fuel delivery systems.

SUMMARY OF THE INVENTION

The present invention provides a control apparatus for an internal combustion engine that allows an operator to calibrate engine performance relative to an engine operating characteristic. The control apparatus comprises a base engine control map that correlates values of the characteristic with values of a base engine control, a trim control map that correlates the values of the characteristic with values of a trim control, an engine control unit that obtains from the base engine control and trim control maps the respective base engine control and trim control values that are based on the characteristic value, and a panel that is operatively coupled with the engine control unit and includes a first switch regulating a trim signal supplied to the engine control unit. The trim control map is separated from the base control map. The engine control unit calculates an engine operating control value based on the obtained values. The calculated engine operating control value is supplied to the internal combustion engine to vary the engine performance. The first switch is adapted to be manipulated by the operator. And the trim signal causes the engine control unit to modify the trim control values in the trim control map.

The present invention provides another control apparatus for an internal combustion engine that allows an operator to calibrate engine performance. The control apparatus comprises a first sensor detecting a first engine operating characteristic of the internal combustion engine, a second sensor detecting a second engine operating characteristic of the internal combustion engine, a set of base engine control maps correlating values of the first and second characteristics with values of a first base engine control and with values of a second base engine control, a set of trim control maps correlating values of the first and second characteristics with values of a first trim control and with values of a second trim control, an engine control unit that obtains from the sets of base engine control and trim control maps the respective the first base engine control, the second base engine control, the first trim control, and the second trim control values that are based on the first and second characteristic values, a panel operatively coupled with the engine control unit and adapted to interface with the operator, and a display receiving from the engine control unit an information signal. The first sensor supplies a first sensor signal that represents the first characteristic. The second sensor supplies a second sensor signal that represents the second characteristic. The set of trim control maps are separate from the set of base control maps. The engine control unit calculates a first engine operating control value based on the obtained values of the first base engine control and the first trim control, and calculates a second engine operating control value based on the obtained values of the second base engine control and the second trim control. The calculated first and second engine operating control values are supplied to the internal combustion engine to vary the engine performance. The panel includes a first switch and a second switch. The first switch regulates a trim signal supplied to the engine control unit, and is adapted to be manipulated by the operator. The trim signal causes the engine control unit to modify at least one of the first and second trim control values in the set of trim control maps. The second switch regulates a trim defeat signal supplied to the engine control unit, and is adapted to be manipulated by the operator between a first configuration and a second configuration. In the first configuration of the second switch, the trim defeat signal causes the engine control unit to calculate the first and second engine control operating values equal to respective ones of the first and second base engine control values as modify by respective ones of the first and second trim control values. In the second configuration of the second switch, the trim defeat signal causes the engine control unit to calculate the first and second engine control operating values equal to respective ones of the first and second base engine control values. The information signal is indicated by the display so as to be interpretable by the operator.

The present invention provides yet another control apparatus for an internal combustion engine that allows an operator to calibrate engine performance. The control apparatus comprises a first sensor detecting a first engine operating characteristic of the internal combustion engine, a second sensor detecting a second engine operating characteristic of the internal combustion engine, a first set of base engine control maps and a second set of base engine control maps, a first set of trim control maps and a second set of trim control maps, an engine control unit obtains from one of the first and second sets of base engine control and trim control maps respective first base engine control, the second base engine control, the first trim control, and the second trim control values that are based on the characteristic values, a data port operatively coupled to the engine control unit, and a panel operatively coupled with the engine control unit and adapted to interface with the operator. The first sensor supplies a first sensor signal that represents the first characteristic. The second sensor supplies a second sensor signal that represents the second characteristic. Each of the first and second sets of base engine control maps includes a first base engine control map and a second base engine control map. Each of the first base engine control maps correlates values of the first and second characteristics with values of a first base engine control, and each of the second base engine control maps correlates values of the first and second characteristics with values of a second base engine control. The first and second sets of the trim control maps are separate from the first and second sets of the base control maps. Each of the first and second sets of trim control maps includes a first trim control map and a second trim control map. Each of the first trim control maps correlates values of the first and second characteristics with values of a first trim control, and each of the second trim control maps correlates values of the first and second characteristics with values of a second trim control. The engine control unit also calculates a first engine operating control value based on the obtained values of the first base engine control and the first trim control, and calculates a second engine operating control value based on the obtained values of the second base engine control and the second trim control. The calculated first and second engine operating control values are supplied to the internal combustion engine to vary the engine performance. The data port is adapted to download the first and second sets of base control maps from an external processor, and is adapted to upload the first and second sets of the trim control maps to the external processor. The panel includes a first switch that regulates a map selection signal supplied to the engine control unit, a second switch that regulates a trim signal supplied to the engine control unit, and a display receiving from the engine control unit an information signal. The first switch is adapted to be manipulated by the operator between a first arrangement and a second arrangement. In the first arrangement of the first switch, the map selection signal causes the engine control unit to access the first set of base control maps and the first set of trim control maps. In the second arrangement of the first switch, the map selection signal causes the engine control unit to access the second set of base control maps and the second set of trim control maps. The second switch is adapted to be manipulated by the operator. The trim signal causes the engine control unit to modify at least one of the first and second trim control values in the set of trim control maps that are assessed according to the arrangement of the first switch. The information signal is indicated by the display so as to be interpretable by the operator.

The present invention also provides a method for allowing an operator to calibrate engine performance relative to first and second engine operating characteristics of an internal combustion engine. The method comprises providing to an engine control unit a set of base control maps and a set of trim control maps, and modifying with trim signals at least one of the first and second trim control values in a corresponding one of the first and second trim control maps. The set of base control maps includes a first base engine control map and a second base engine control map. The first base engine control map correlates values of the first and second characteristics with values of a first base engine control, and the second base engine control map correlates values of the first and second characteristics with values of a second engine control. The set of trim control maps includes a first trim control map and a second trim control map. The first trim control map correlates values of the first and second characteristics with values of a first trim control, and the second trim control map correlates values of the first and second characteristics with values of a second trim control. The engine control unit obtains from the based engine control and trim control maps respective first base engine control, second base engine control, first trim control, and second trim control values that are based on the characteristic values. The engine control unit also calculates a first engine operating control value based on the obtained values of the first base engine control and the first trim control, and calculates a second engine operating control value based on the obtained values of the second base engine control and the second trim control. The calculated first and second engine operating control values are supplied to the internal combustion engine to vary the engine performance. The trim signals are regulated by a first switch adapted to be manipulated by the operator.

BRIEF DESCRIPTION OF THE DRAWINGS

The accompanying drawings, which are incorporated herein and constitute part of this specification, include one or more embodiments of the invention, and together with a general description given above and a detailed description given below, serve to disclose principles of the invention in accordance with a best mode contemplated for carrying out the invention.

DETAILED DESCRIPTION OF THE INVENTION

As they are used in connection with the present invention, the expressions "trim" or "trimming," "group," "map trim definition," and "map set" have specific meanings. The expressions "trim" and "trimming" refer to changing the value of one or more setpoints. The value of this change, which can be positive or negative, can be a function of the original setpoint or a selected increment. The expression "group" refers to an aggregation or parcel of setpoints that are acted upon in unison by a trimming action. A group can be defined by a "map trim definition." For example, a map trim definition can parcel out an engine control map so as to create a group of setpoints that lie within a selected range(s) of the independent variable(s), e.g., sensed engine operating characteristics. The expression "map set" refers to a single engine control map or to an association of plural related engine control maps. For example, a map set can consist solely of an ignition timing map. Alternatively, a map set can comprise an ignition timing map and a fuel delivery map.

Figure 1:
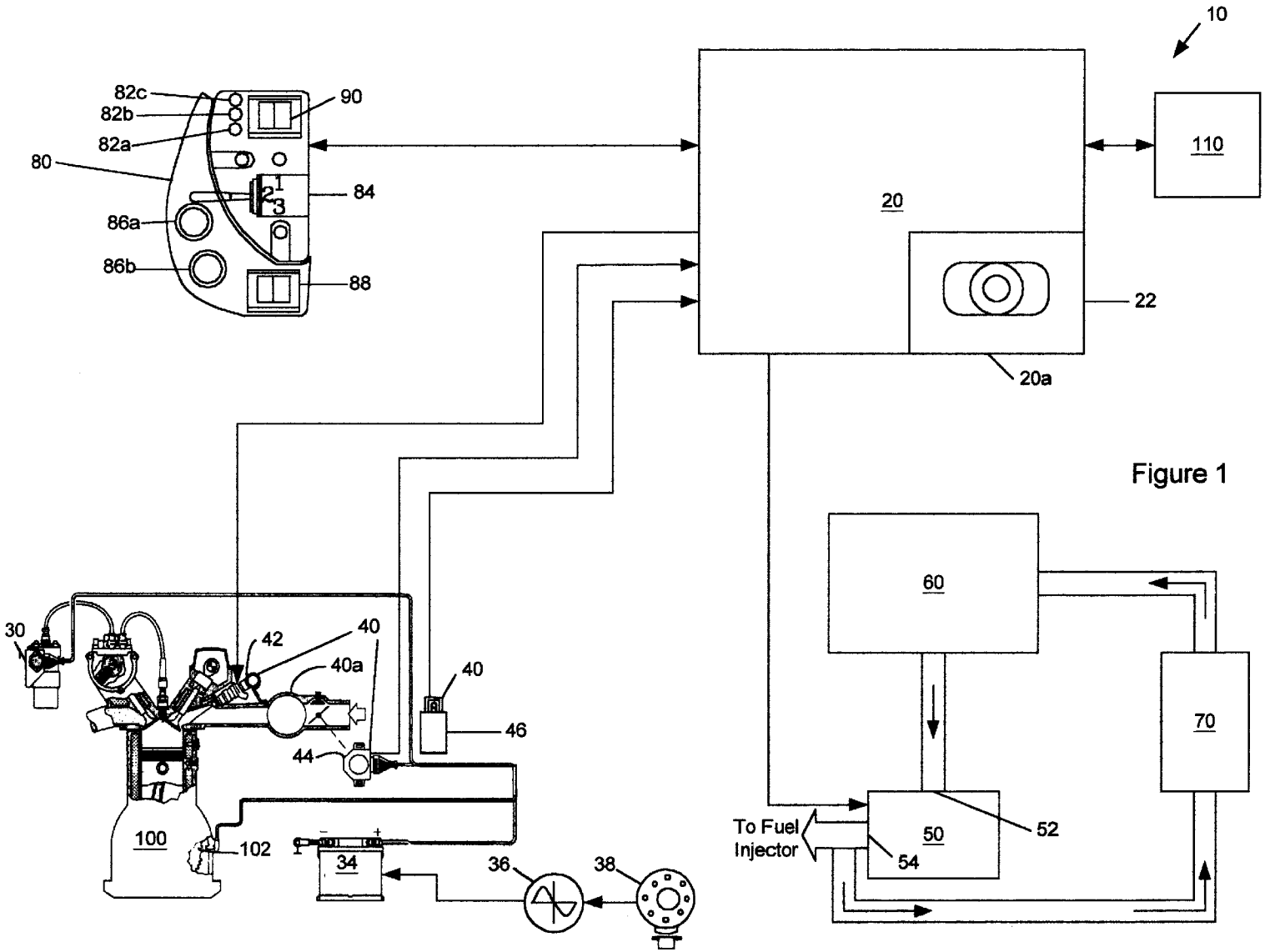
FIG. 1 is a schematic illustration of an embodiment of a system for calibrating engine operation

Referring to FIG. 1, a system 10 for calibrating engine performance includes an engine control unit 20 that is coupled (e.g., via wires or wirelessly) to one or more input or output devices (e.g., sensors or actuators). The engine control unit 20 can include a processor that uses coded instructions to act on electrical input signal(s) and to supply electrical output signal(s). According to one embodiment, wires electrically connect the engine control unit 20 with various other components, which will be described in detail below. The housing 20*a* of the engine control unit 20 and the other components can be electrically grounded with respect to a vehicle chassis (not shown), e.g., a motorcycle frame, in a known manner. The electrical connections with respect to the engine control unit 20 can comprise two female sockets (not shown) mounted on the housing 20*a* for receiving corresponding right-angle male plugs (not shown) at ends of a wiring loom (not shown). Of course, any number of male plugs and any number of female sockets, in any combination and configuration, may be associated with either the housing 20*a* or the wiring loom.

The engine control unit 20 can be installed beneath an operator's seat (not shown). The engine control unit 20 can be pivotally mounted to facilitate accessibility to the electrical connections and to an ignition coil 30 that can be mounted on the underside of the engine control unit 20. Pivoting the engine control unit also facilitates draining contaminates from a barometric pressure sensor 22 that can be incorporated within the housing 20*a* of the engine control unit 20. The functions of the ignition coil 30 and the barometric pressure sensor 22, and their relationship to the engine control unit 20, will be described below in greater detail. Additionally, either or both of the ignition coil 30 and the barometric pressure sensor 22 can be mounted apart from the engine control unit 20.

According to one embodiment, the engine control unit 20 can provide a single engine operating control value, i.e., for adjusting a single engine control, such as ignition timing. However, according to another embodiment, which is shown in the figures, the engine control unit 20 can provide a plurality of engine operating control values, i.e., for controlling a plurality of engine controls, such as fuel quantity and ignition timing.

The engine control unit 20 is electrically connected to a fuel delivery module 40. The fuel delivery module 40 can include at least one fuel injector 42 that can be mounted on a throttle body 40*a* extending from a fluid inlet (not shown) to a fluid outlet (not shown). A butterfly valve (not shown) is positioned in the throttle body 40*a* between the inlet and the outlet, and is pivotal about an axis (not shown) between a first configuration preventing fluid flow through the throttle body 40*a* and a second configuration permitting fluid flow through the throttle body 40*a*. An actuator cam (not shown) is connected to the butterfly valve for pivoting the butterfly valve, against the bias of a return spring, e.g., a torsion spring (not shown), from the first configuration to the second configuration. The actuator cam can be connected, via a throttle cable (not shown), to a throttle control element (not shown), which can be operator controlled. As will be discussed in greater detail below, a throttle position sensor 44 is also connected to the butterfly valve for measuring the angular position of the butterfly valve as it is pivoted about the axis.

The fuel injector(s) 42 can be oriented so as to spray a precisely metered amount of fuel from inside the throttle body 40*a* toward an intake port (not shown) in a two-stroke engine or through a poppet valve opening (not shown) in a four-stroke engine. In the case of four-stroke engine designs having a plurality of intake valves (not shown), each of the injectors 42 can be oriented so as to spray fuel through a respective valve opening.

The fuel delivery module 40 may further comprise an intake air-temperature sensor 46 that can be, for example, mounted through the wall of the throttle body 40*a,* and upstream from the butterfly valve. The functions of the air-temperature sensor 46 and its relationship to the engine control unit 20, will be described below in greater detail.

The fuel delivery module 40, in cooperation with the engine control unit 20, provides a number of advantages including the ability to be adjusted electronically without being removed, disassembled, reassembled, and reinstalled. Another advantage is the ability to be electronically adjusted while the engine is running. Another advantage is the ability to provide separate control of different groups of setpoints that are specified by map trim definitions, which will be described below in greater detail. Yet another advantage is that the fuel injector(s) 42 can be programmed to compensate for changes in ambient conditions, e.g., changes in barometric pressure or air-temperature. According to embodiments of the system 10, it is possible to compensate for variations in the voltage available to actuate the fuel injector(s) 42, and with a lambda sensor, to also compensate for wear and aging of the fuel injector(s) 42.

An electrically operated fuel pump 50 having a low pressure fuel inlet 52 receiving fuel from a fuel tank 60 and a high-pressure fuel outlet 54 can deliver pressurized fuel to the fuel injector(s) 42. The fuel pump 50, which can be electrically interconnected with the engine control unit 20, can be a positive displacement type pump or a dynamic type pump. A pressure regulator 70 can be connected to the high-pressure fuel outlet 54 for regulating the pressure of the fuel supplied to the fuel injector(s) 42. The pressure regulator 70 can relive excess pressure by returning a portion of the high-pressure fuel stream to the fuel tank 60. The fuel pump 50 can be mounted wherever space permits, e.g., on the exterior of an engine 100.

A fuel filter (not shown), which can be serviceable, can be a separate unit located at any position along the fuel supply, or the fuel filter can be incorporated within the fuel tank 60, fuel pump 50, fuel injector(s) 42, or pressure regulator 70.

Figure 2:
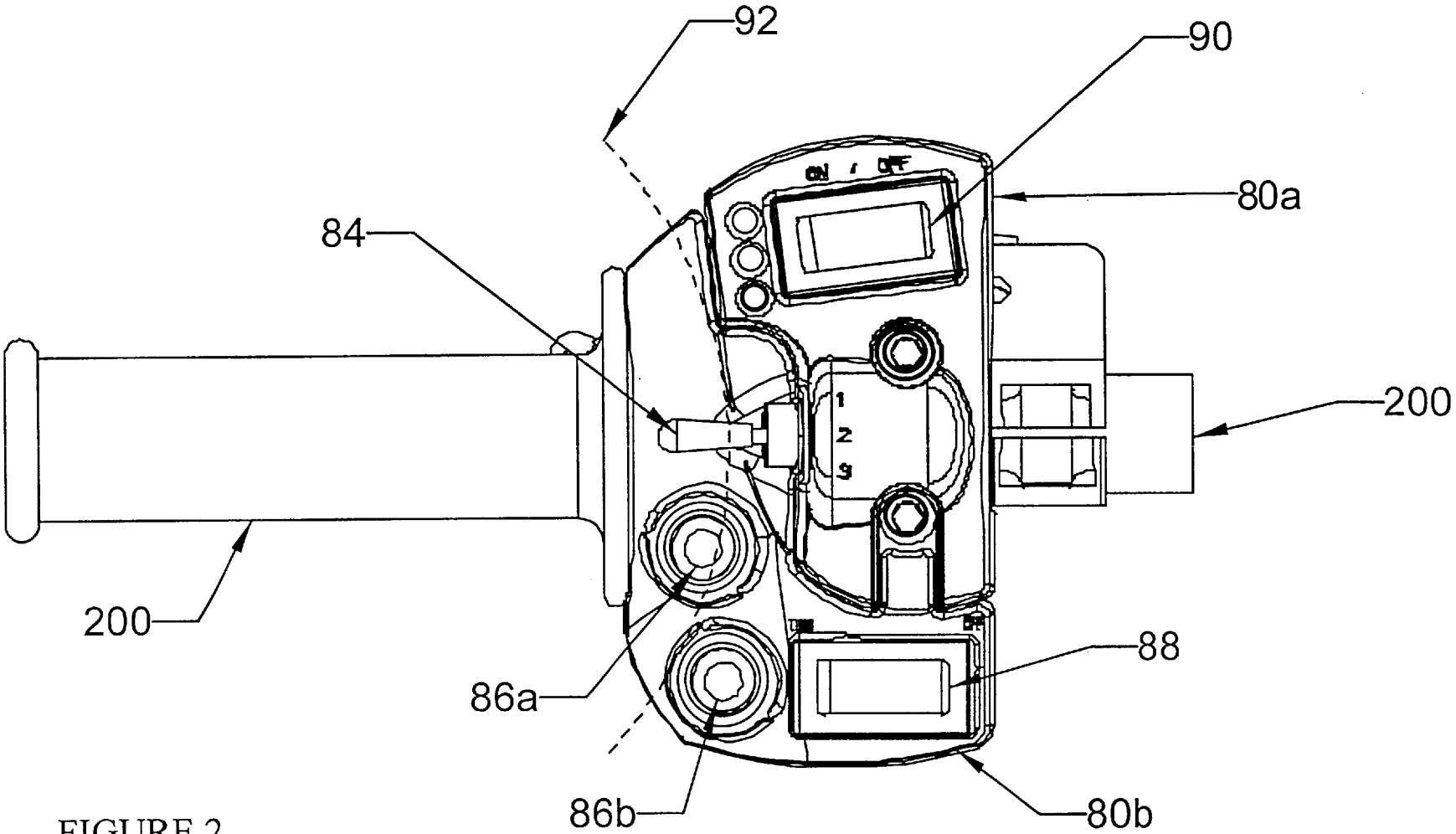
FIG. 2 is a plan view of an embodiment of a dash for the system illustrated in FIG. 1.
Figure 3:
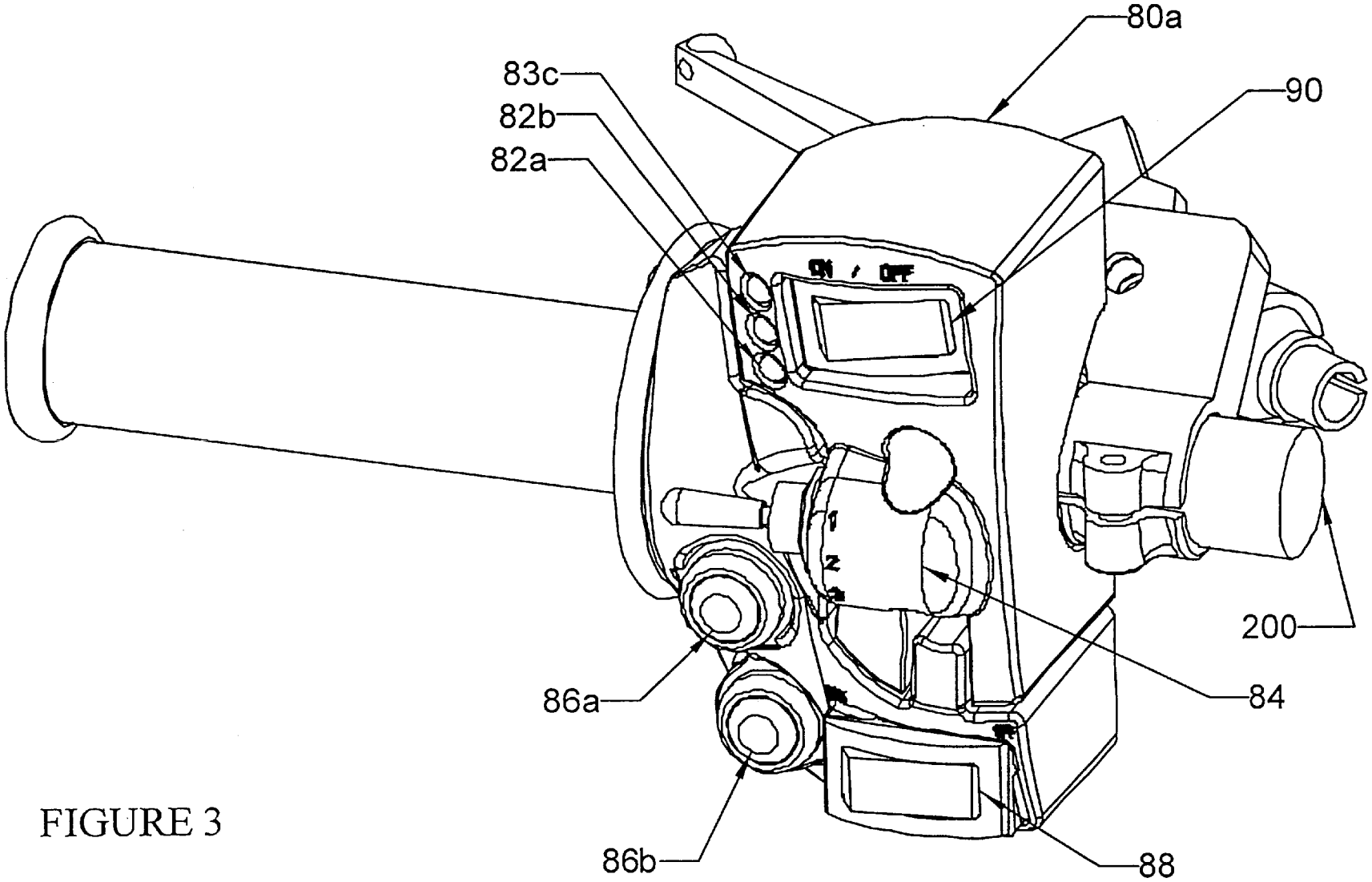
FIG. 3 is a perspective view of the dash shown in FIG. 2 in an attached configuration.
Figure 4:
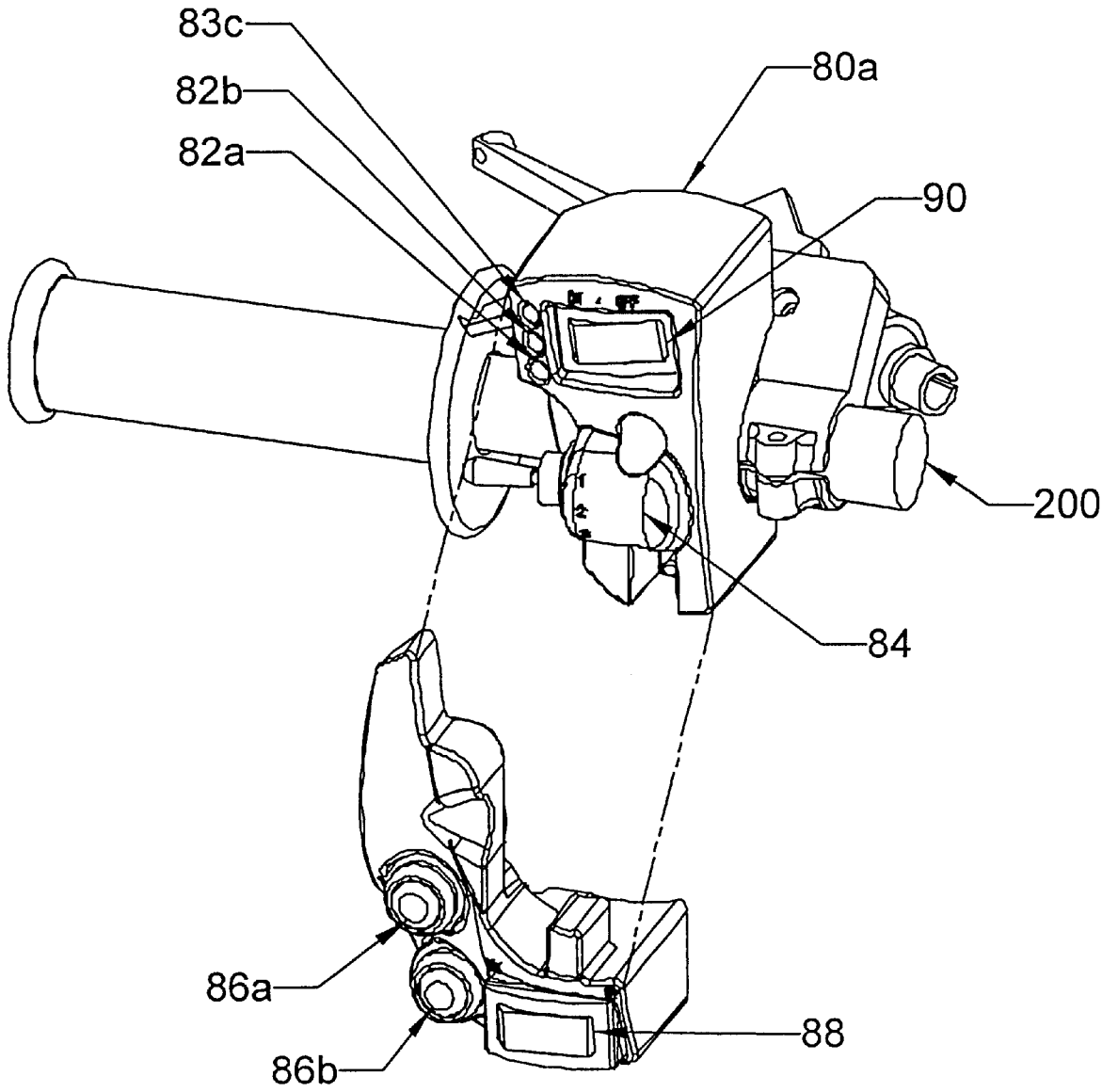
FIG. 4 is an exploded perspective view of the dash shown in FIG. 2 in a detached configuration.

Referring additionally to FIGS. 2–4, the engine control unit 20 is electrically connected to a dash panel 80 that is readily accessible to an operator, e.g., the rider in the case of a motorcycle. The dash panel 80 can comprise at least one switch for regulating a trim signal supplied to the engine control unit 20 and can comprise at least one display device 82 for conveying to the operator information supplied from the engine control unit 20. As shown in FIGS. 2–4, the dash panel 80 can include a map set selection switch 84, at least one trim +/– adjustment switch 86 (e.g., a trim + pushbutton 86*a* and a separate trim – pushbutton 86*b* are shown in FIGS. 2–4), a trim defeat switch 88, and an on/off switch 90. The trim defeat switch 88 regulates a trim defeat signal that causes the engine control unit 20 to perform two functions. In an "on" position of the trim defeat switch 88, the engine control unit 20 calculates the engine operating control values equal to the base engine control values as modified by trim control values, and the engine control unit 20 processes the trim signals (as regulated by the at least one trim +/– adjustment switch 86) and the trim defeat signals (as regulated by the trim defeat switch 88). In the "off" position of the trim defeat switch 88, the engine control unit 20 calculates the engine operating control values equal to only the base engine control, and the engine control unit 20 ignores the trim signals (as regulated by the at least one trim +/– adjustment switch 86) and the trim defeat signals (as regulated by the trim defeat switch 88). The on/off switch 90 activates or deactivates electricity to all of the components of the apparatus 10. For example, the on/off switch 90 can disconnect the battery 34 and the alternator (i.e., stator 36 and rotor 38) from the engine control unit 20. The display device 82 can be any analogue or digital device, and can display alpha-numeric characters or graphical images. As shown in FIGS. 2–4, the display device 82 can include three "smart" lights 82*a,*82*b,*82*c*. The functions of the switches 84,86,88,90 and display device 82 on the dash panel 80, as well as their relationship to the engine control unit 20, will be described below in greater detail.

The dash panel 80 is mounted with respect to the operator for ergonomic actuation of the switches 84,86,88,90 and ready visibility of the display device 82. For example, in the case of a motorcycle, the dash panel 80 can be mounted on the handle-bars 200, e.g., proximate to the left-hand grip 202. Of course, the dash panel 80 could be located at other positions that are readily accessible/visible to the rider in the course of operating the motorcycle. By locating the dash panel 80 as shown in FIGS. 2–4, the switches 84,86,88,90 can be ergonomically arranged so as to facilitate tactile identification and operation of the switches 84,86,88,90 using the rider's left thumb. Broken line 92 indicates a possible line of travel of the rider's thumb. Moreover, the smart lights 82*a,*82*b,*82*c* are presented to the rider such that even a quick glance can enable the rider to ascertain whatever information, as specified by the smart light definitions, that is provided by the smart lights 82*a,*82*b,*82*c*.

As best seen in FIG. 4, the dash panel 80 can be comprised of a fixed portion 80*a* and a detachable portion 80*b*. The fixed portion 80*a,* which includes the display device 82, the map selection switch 84, and the on/off switch 90, is fixed with respect to the handlebars 200. The detachable portion 80*b,* which includes the at least one trim +/– adjustment switch 86 and the trim defeat switch 88, is detachable relative to the handle bars 200. Thus, the detachable portion 80*b* can be removed when it is no longer necessary for the rider to calibrate the engine 100.

Referring now to all of the figures, the functions and relationships of the system components will now be described. As the system 10 is shown in the figures, the engine control unit 20 supplies a first control signal for a first engine control, e.g., fuel quantity, and a second control signal for a second engine control, e.g., ignition timing. Thus, for each map set stored in the engine control unit 20, there is an ignition timing map and a fuel amount map. However, in general, a map set can include different numbers of maps (i.e., only one or more than two), different types of maps (e.g., fuel timing, power jet actuation, or power valve actuation), or different combinations of map types (e.g., ignition timing, fuel timing, and power valve actuation).

Table 1 shows an example of a map that includes an arbitrarily selected number of ignition timing setpoints. Each setpoint corresponds to the values of two engine operating characteristics, i.e., an engine speed value and a throttle position setting value. Thus, for a given value of engine speed (e.g., as sensed by or derived from an output signal from a crankshaft angular motion sensor 102) and for a given value of throttle position setting (e.g., as measured by the throttle position sensor 44), an ignition timing setpoint is assigned. For example, this map tells the engine control unit 20 to deliver an ignition timing of 5 degrees before top dead center (BTDC) at 2000 revolutions per minute (r.p.m.), regardless of throttle opening. At 5000 r.p.m., the engine control unit 20 will vary ignition timing from 25 degrees BTDC, when the throttle is closed, to 30 degrees BTDC, when the throttle is open 75% or more.

TABLE 1

| Ignition Timing | | Engine speed (revolutions per minute) | | | |
|---|---|---|---|---|---|
| (degrees BTDC) | | 0 | 2000 | 5000 | 7000 |
| Throttle opening (percentage) | 0 | 0 | 5 | 25 | 14 |
| | 25 | 0 | 5 | 27 | 12 |
| | 50 | 0 | 5 | 29 | 10 |
| | 75 | 0 | 5 | 30 | 9 |
| | 100 | 0 | 5 | 30 | 7 |

In general, a map will include a great number of setpoints that can be assigned for every conceivable engine performance, as determined by measuring one or more engine operating characteristics. If a map includes gaps between specified values of the characteristics (e.g., in Table 1, there are gaps of 2000 r.p.m. or more between the specified values for engine speed), the engine control unit 20 can interpolate the operating control values between two specified characteristic values.

The map sets can be downloaded to the engine control unit 20, via a data port 110, from an external processor (not shown) such as a desktop personal computer, a laptop personal computer, or a palm-size personal computer. In addition to map sets, a download can include map trim definitions (and smart light definitions), as well as software updates for the engine control unit 20. The inventors have discovered a number of unexpected results that are achieved by using a palm-size personal computer for downloading to a motorcycle engine control unit. Specifically, the relative cost of a palm-size personal computer with respect to the cost of laptop or desktop personal computers, as well as the reduced size, reduced weight, and increased tolerance to mechanical shock (such as may be caused by impacts, bouncing, jarring, etc.) of palm-size personal computers relative to laptop or desktop personal computers, are all advantageous. With regard to the latter, the small size, low weight, and increased tolerance to mechanical shock can even make it possible for a motorcycle rider participating in an endurance event to carry the palm-size personal computer on-board during the event, e.g., in a clothing pocket or in a storage compartment on the motorcycle. Communication with the engine control unit 20 for configuring the trim system can be accomplished using OPT Cal software, which is a personal computer based calibration tool manufactured by Optimum Power Technology. Using OPT Cal software, the engine operator can tell the engine control unit 20 which map set is to be activated, the map trim definitions that designate the active, i.e., modifiable, portions of the map set, and the smart light definitions. The data port 110 used to transfer data between the personal computer and the engine control unit 20 can be any configuration (e.g., using a physical connection such as a docking or a cable, using transceiving techniques, etc.) and can use any protocol (e.g., RS-232 or ISO 9141).

In addition to processing downloaded data, the engine control unit 20 can also be connected to any necessary on-board sensor. The air-temperature sensor 46 and barometric pressure sensor 22 can provide sensor signals representing the density of the air being inducted into the engine 100, and can be used to effect global changes to all control signals based on the values in each map set that has been downloaded to the engine control unit 20. In connection with this invention, the expression "global" refers to making an adjustment with respect to every setpoint in a control map, whereas "local" refers to a setpoint or a group of setpoints in a control map. The sensor signals from the engine speed sensor 102 and throttle position sensor 44, in addition to being monitored by the engine control unit 20 for accessing setpoints, can be used to determine which setpoint(s) is to be the basis for trimming. Using the system 10 in connection with the fuel delivery system 40 including fuel injector(s) 42 can be considered to be analogous to carburetor jetting, i.e., below a certain throttle opening, trimming according to the present invention corresponds to changing the slow jet, trimming at higher throttle openings corresponds to changing the needle jet, and trimming at still higher throttle openings corresponds to changing the main jet. However, unlike the trims according to the system 10, most jet changes cannot be done while the engine is operating.

Additionally, a sensor (not shown) for electrical system voltage can measure variations that directly affect the reaction time and accuracy of the electromechanical movements within the fuel injector(s) 42. Sensors (not shown) for gear position and side stand deployment can be used to alert a motorcycle rider to potentially harmful or dangerous conditions. And a sensor (not shown) for detecting the initiation of a gear change can signal the engine control unit 20 to momentarily cut-off the ignition system or the fuel delivery module 40, thereby facilitating smoother shifts. Of course, the engine control unit 20 can be connected to many other sensors, e.g., sensors (not shown) for engine coolant temperature or oil pressure that can provide a warning to the engine operator.

The engine control unit 20 also receives trim signals, trim defeat signals, and map selection signals from the dash panel 80, and activates the smart lights 82*a*,82*b*,82*c* as appropriate, in accordance with the smart light definitions. The trim functions are controlled by the map set selection switch 84, the at least one map trim +/– switch 86, and the map trim defeat switch 88. As it is shown in FIGS. 2–5, the map set selection switch 84 can be a three-position toggle switch, thereby providing a choice of three map sets. Alternatively, the map set selection switch 84 can provide a choice of only two map sets or more than three map sets. The possible permutations of map sets that can be selected is very large. As a first example, the center position of the map set selection switch 84 can be assigned to a map set that optimizes the acceleration of a vehicle from a resting position, the lower position of the map set selector switch 84 can be assigned to the map set that is to be used a majority of the time, and the upper position of the map set selection switch 84 can be used when peak power output is required.

As a second example, the lower position of the map set selector switch 84 can be assigned, in accordance with the accompanying map trim definitions, to enable the ignition timing map to be trimmed, and the upper position of the map set selection switch can be assigned, in accordance with the accompanying map trim definitions, to enable the fuel quantity map to be trimmed.

The map trim +/− switch 86 can be a three-position rocker switch for incrementing or decrementing the trim control values based on the currently active setpoint (or group of setpoints including the currently active setpoint) by a specified function or amount. Alternatively, rocking the map trim +/− switch 86 to either of the (+) or (−) can initiate a complex set of adjustments to a group of setpoints including the currently active setpoint. As an example of such a complex adjustment, the adjustments to each of the setpoints in the group can be proportional to the adjustment applied to the currently active setpoint. Also, as discussed above, the adjustments signaled by the map trim +/− switch 86 can be applied to the currently selected map, or can be applied to all like maps. As shown in FIGS. 2–5, separate pushbuttons 86*a*,86*b* can be substituted for the three-position rocker-type map trim +/− rocker switch 86.

The map trim defeat switch 88 allows the engine operator to perform instant comparisons, i.e., "ABAB," between the base map set and the trimmed map set. Moreover, these comparisons can be performed while the engine is being continuously operated in its intended environment. The map trim defeat switch 88 also signals the engine control unit 20 whether or not to process inputs from the map trim +/− switch 86.

As shown in FIGS. 2–4, the display device 82 can comprise a set of three smart lights 82*a*,82*b*,82*c* that assist the engine operator in the trimming process. The smart lights 82*a*,82*b*,82*c* can be set-up in accordance with the active smart light definitions to convey different information. For example, the smart lights 82*a*,82*b*,82*c* can indicate if the engine is currently performing in a part of the map that the trims are active, or whether an attempt has been made to trim above or below safe maximum or minimum values that are predetermined by the engine operator. The smart lights 82*a*,82*b*,82*c* can also be defined to alert the engine operator to such conditions as a sensor failure, low battery voltage, or engine overheating. In addition to having different modes of operation (i.e., dark, continuously glowing, slow flashing, and rapid flashing), the smart lights 82*a*,82*b*,82*c* can have different colors (e.g., green, amber, and red) to further increase the amount of information that can be ascertained with only a glance by the operator.

Figure 5:
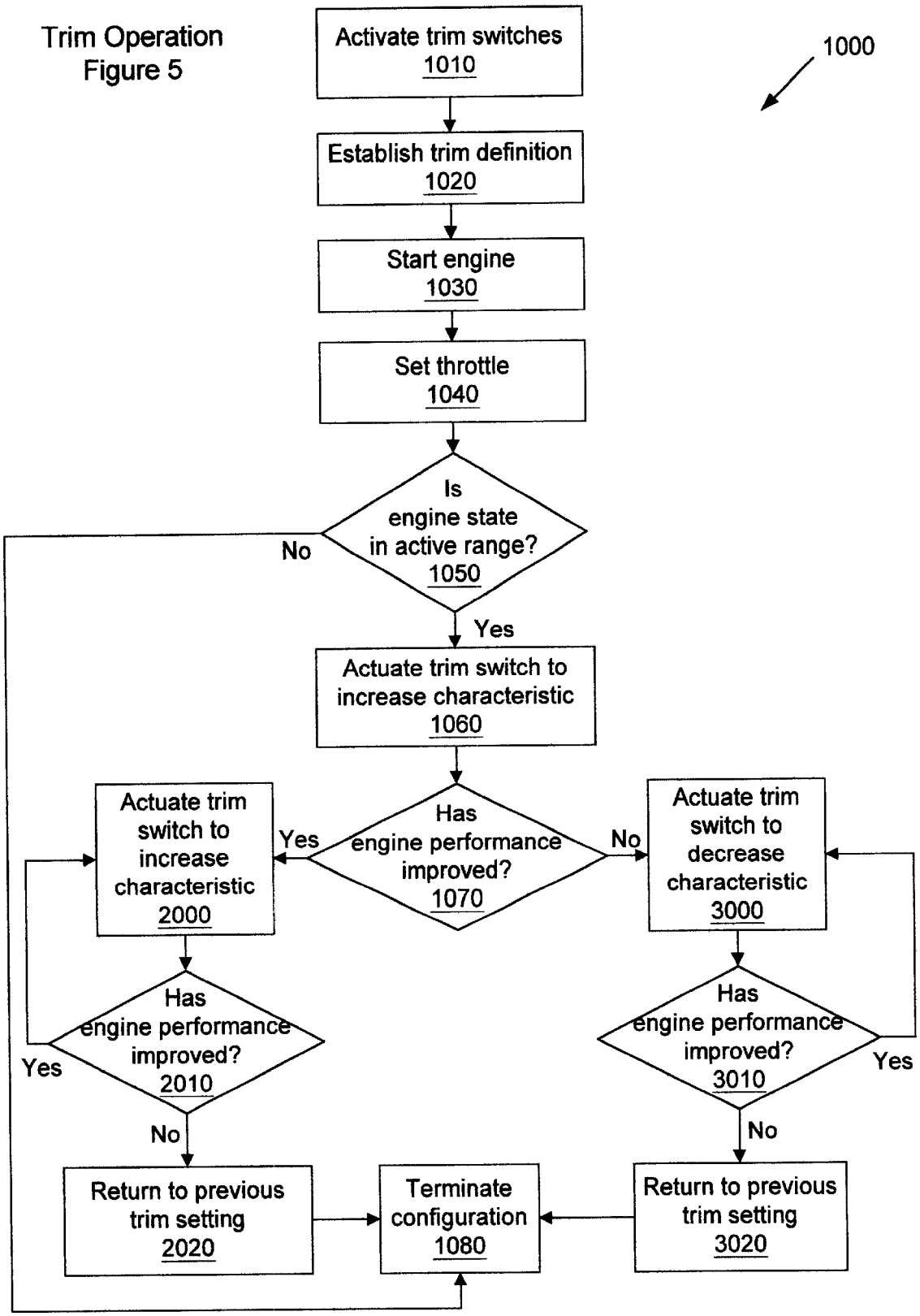
FIG. 5 is a flow chart illustrating a method of calibrating engine performance in accordance with the present invention.

FIG. 5 illustrates an example of a method 1000 for using the system 10 to trim the idle performance of the engine 100 with the object of calibrating a fuel delivery map to obtain optimal idle speed performance. In step 1010, the map trim defeat switch 88 is configured to activate the map trim +/− switches 86*a*, 86*b*. In step 1020, the system 10 is set-up. The set-up 1020 can include: 1) establishing map trim definitions to designate small throttle settings (e.g., 0–10% throttle opening) as the active range, and to limit trim capability (e.g., no more than +/− 20% of setpoint value in the base control map), 2) establishing smart light definitions so that light 82*c* glows steadily if the throttle position sensor 44 supplies a sensor signal indicating that the engine 100 is performing in the active range, and 3) downloading to the engine control unit 20 (e.g., via the data port 110) a map set, the map trim definitions, and the smart light definitions. In step 1030, the engine 100 is started. In step 1040, the operator releases throttle so as to allow the engine 100 to idle. In step 1050, the engine control unit 20 decides, based on the sensor signal supplied from the throttle position sensor 44, if the engine state is within the active range according to the map trim definitions. If the decision in step 1050 is negative (i.e., "no"), the engine control unit 20 does not supply the display 82 with an information signal to turn-on smart light 82*c*. If the decision in step 1050 is positive (i.e., "yes"), the engine control unit 20 supplies to the display 82 an information signal to turn-on smart light 82*c*, thereby providing an indication to the operator that manipulating the trim +/− switches 86*a*, 86*b* and the trim defeat switch 88 are effective to calibrate the engine 100. In step 1060, after a positive decision in step 1050, the operator presses the trim + pushbutton 86*a*. In step 1070, the operator, with or without assistance from the display 82, decides if the engine performance has varied such that the engine 100 is rotating faster (i.e., an increase in r.p.m.).

In step 2000, after a positive decision in step 1070, the operator again presses the trim + switch 86*a*. In step 2010, the operator again decides if the engine performance has varied such that the engine 100 is rotating faster (i.e., an increase in r.p.m.). If the decision in step 2010 is positive, step 2000 is repeated. Step 2000 is repeated until either the trim capability limit (e.g., a trim signal adding 20% to the base engine control value of the setpoint value according to the base control map) is reached (not shown), or the operator decides that the engine performance has varied such that the engine 100 is rotating slower (i.e., a decrease in r.p.m.). If the decision in step 2010 is negative, the operator presses the trim − pushbutton 86*b* to return to the previous engine performance.

In step 3000, after a negative decision in step 1070, the operator presses the trim − pushbutton 86*b*. In step 3010, the operator again decides if the engine performance has varied such that the engine 100 is rotating faster (i.e., an increase in r.p.m.). If the decision in step 3010 is positive, step 3000 is repeated until either the trim capability limit (e.g., a trim signal subtracting 20% from the base engine control value of the setpoint value according to the base control map) is reached (not shown), or the operator decides that the engine performance has varied such that the engine 100 is rotating slower (i.e., a decrease in r.p.m.). If the decision in step 3010 is negative, the operator presses the trim + pushbutton 86*a* to return to the previous engine performance.

In step 1080, the operator has successfully optimized the idle speed performance of the engine 100, i.e., within the active range according to the map trim definitions.

The map trim defeat switch 88 can be operated to perform an ABAB comparisons to evaluate the effect of trimming the engine 100 as compared to the base control map. The compilation of the trim control values selected by the operator are stored in the trim control map set and can be uploaded to the personal computer for modifying the base map set, thereby creating a fresh base map that can be used subsequently.

Thus, the system 10 provides many advantages including calibrating engine performance with adjustments that can be made while the engine 100 is being operated in its intended environment, and enabling an ABAB comparison during this operation to evaluate the effectiveness of the adjustments. An "ABAB" comparison refers to the operator alternately manipulating the trim defeat switch 88 between its first and second configurations. In the first configuration of the trim defeat switch 88, a trim defeat signal causes the engine control unit 20 to calculate the engine operating control values equal to the base engine control values modify by the trim control values (i.e., with the trim control map modifying the base control map). In the second configuration of the trim defeat switch 88, the trim defeat signal causes the engine control unit 20 to calculate the engine operating control values equal solely to the base engine control values (i.e., without the trim control map modifying the base control map).

Additionally, embodiments of the system 10 can be provided as a kit such that the engine control unit 20 and an ignition module can replace an existing ignition system, and the fuel delivery system 40 and fuel pump 50 can replace an existing carburetor. The kit can additionally include a replacement wiring loom (not shown) to be substituted for the existing wiring loom. Another advantage of the system 10 is that its functions are universally applicable, i.e., the system 10 is not vehicle model specific, and all the main components can be transferred between different vehicles with only an additional loom or a software upgrade to the engine control unit 20 possibly required for the second vehicle.

The embodiments of the system 10 can be provided for internal combustion engine powered land traversing vehicles, watercraft, and flying vehicles, and thus include motorcycles, all-terrain vehicles, snowmobiles, boats, personal watercraft, and airplanes.

The embodiments described above are examples of the present apparatus and method for trimming an engine management system whereby a number of advantages are achieved.

These advantages include allowing engine operation to be calibrated during continuous operation in the engine's intended environment. For example, the performance of a race engine can be calibrated during a race, without stopping the engine and without coming into the pits. Moreover, engine performance can be modified within particular user defined ranges of engine performance.

These advantages also include allowing map set(s) to be provided to the engine control unit 20 as downloads from an external processor, e.g., a palm size personal computer. These map sets can be provided to the external processor via any known data transfer technique or protocol, including via the World Wide Web or by computer diskette.

These advantages further include providing trim controls on a dash panel 80 that are readily accessible to the engine operator in the course of continuously operating the engine in its intended environment. For example, the dash panel 80 can comprise at least one switch mounted so as to be readily actuatable by a finger of a hand grasping the left-hand grip 202 of motorcycle handlebars 200. The trim control switches can be ergonomically positioned on the dash panel 80 to facilitate tactile identification and operation of the controls by a rider wearing gloves.

These advantages yet further include providing one or more display devices 82 on the dash panel 80 that are capable of conveying information with only a brief glance by the engine operator. These display devices 80 can include a plurality of "smart," i.e., definable operation, lights 82*a*, 82*b*, 82*c* that can use different modes (e.g., off, steady glow, slow flashing, rapid flashing, etc.) to present different types of information (e.g., engine status, engine control unit status, trim conditions, etc.). The definitions for operating these smart lights 82*a*,82*b*, 82*c* can be downloaded to the engine control unit 20 at the same time as the map set(s) are downloaded to the engine control unit 20.

While the present invention has been disclosed with reference to certain embodiments, numerous modifications, alterations, and changes to the described embodiments are possible without departing from the sphere and scope of the present invention, as defined in the appended claims. Accordingly, it is intended that the present invention not be limited to the described embodiments, but that it have the full scope defined by the language of the following claims, and equivalents thereof.

What is claimed is:

1. A control apparatus for an internal combustion engine that allows an operator to calibrate engine performance relative to an engine operating characteristic, the control apparatus comprising:

a base engine control map correlating values of the characteristic with values of a base engine control;

a trim control map separate from the base engine control map, the trim control map correlating the values of the characteristic with values of a trim control;

an engine control unit obtaining from the base engine control and trim control maps the respective base engine control and trim control values that are based on the characteristic value, and calculating an engine operating control value based on the obtained values, the calculated engine operating control value being supplied to the internal combustion engine to vary the engine performance; and a panel operatively coupled with the engine control unit and including a first switch regulating a trim signal supplied to the engine control unit, the first switch being adapted to be manipulated by the operator, and the trim signal causing the engine control unit to modify at least two trim control values in the trim control map each time the first switch is manipulated.

2. The control apparatus according to claim 1, further comprising:

a data port operatively coupled to the engine control unit, wherein the data port is adapted to download the base control map from an external processor and is adapted to upload the trim control map to the external processor.

3. The control apparatus according to claim 1, further comprising:

a sensor detecting the characteristic and supplying to the engine control unit a sensor signal representing the characteristic.

4. The control apparatus according to claim 1, further comprising:

a display receiving from the engine control unit an information signal, the information signal being indicated by the display so as to be interpretable by the operator.

5. The control apparatus according to claim 1, wherein the panel further includes a second switch regulating a trim defeat signal supplied to the engine control unit, the second switch being adapted to be manipulated by the operator between a first configuration and a second configuration, in the first configuration of the second switch the trim defeat signal causing the engine control unit to calculate the engine operating control value equal to the base engine control value modified by the trim control value, and in the second configuration of the second switch the trim defeat signal causing the engine control unit to calculate the engine operating control value equal to the base engine control value.

6. The control apparatus according to claim 1, wherein the engine control unit comprises a processor, and the trim signal comprises an electrical signal.

7. A control apparatus for an internal combustion engine that allows an operator to calibrate engine performance, the control apparatus comprising:

a first sensor detecting a first engine operating characteristic of the internal combustion engine, the first sensor supplying a first sensor signal representing the first characteristic;

a second sensor detecting a second engine operating characteristic of the internal combustion engine, the second sensor supplying a second sensor signal representing the second characteristic;

a set of base control maps correlating values of the first and second characteristics with values of a base first engine control and with values of a second base engine control;

a set of trim control maps separate from the set of base control maps, the set of trim control maps correlating values of the first and second characteristics with values of a first trim control and with values of a second trim control;

an engine control unit obtaining from the base control and trim control maps the respective first base engine control, the second base engine control, the first trim control, and the second trim control values that are based on the characteristic value, calculating a first engine operating control value based on the obtained values of the first base engine control and the first trim control, and calculating a second engine operating control value based on the obtained values of the second base engine control and the second trim control, the calculated first and second engine operating control values being supplied to the internal combustion engine to vary the engine performance;

a panel operatively coupled with the engine control unit and adapted to interface with the operator, the panel including:

a first switch regulating a trim signal supplied to the engine control unit, the first switch being adapted to be manipulated by the operator, and the trim signal causing the engine control unit to modify at least one of the first and second trim control values in the set of trim control maps;

a second switch regulating a trim defeat signal supplied to the engine control unit, the second switch being adapted to be manipulated by the operator between a first configuration and a second configuration, in the first configuration of the second switch the trim defeat signal causing the engine control unit to calculate the first and second engine operating control values equal to respective ones of the first and second base engine control values modified by respective ones of the first and second trim control values, and in the second configuration of the second switch the trim defeat signal causing the engine control unit to calculate the first and second engine operating control values equal to respective ones of the first and second base engine control values; and a display receiving from the engine control unit an information signal, the information signal being indicated by the display so as to be interpretable by the operator.

8. The control apparatus according to claim 7, further comprising:

a platform commonly supporting the first sensor, the second sensor, the engine control unit, and the panel.

9. The control apparatus according to claim 8, wherein the platform comprises one of a motorcycle, an all-terrain vehicle, a snowmobile, a boat, a personal watercraft, and an airplane.

10. The control apparatus according to claim 8, wherein the platform comprises one of a land traversing vehicle, a watercraft, and a flying vehicle.

11. The control apparatus according to claim 7, further comprising:

a data port operatively coupled to the engine control unit, wherein the data port is adapted to download the set of base control maps from an external processor and is adapted to upload the set of trim control maps to the external processor.

12. The control apparatus according to claim 7, wherein the first characteristic comprises engine speed and the second characteristic comprises engine load.

13. The control apparatus according to claim 12, wherein the first sensor comprises a tachometer and the second sensor comprises a throttle position sensor.

14. The control apparatus according to claim 12, wherein the first base engine control comprises fuel quantity and the second base engine control comprises ignition timing.

15. The control apparatus according to claim 14, wherein each set of the base control maps comprises a base fuel map correlating engine speed and engine load with fuel quantity and comprises a base ignition map correlating engine speed and engine load with ignition timing.

16. The control apparatus according to claim 7, wherein the engine control unit comprises a processor, and the first sensor signal, the second sensor signal, the trim signal, the trim defeat signal, and the information signal each comprise an electrical signal.

17. A control apparatus for an internal combustion engine that allows an operator to calibrate engine performance, the control apparatus comprising:

a first sensor detecting a first engine operating characteristic of the internal combustion engine, the first sensor supplying a first sensor signal representing the first characteristic;

a second sensor detecting a second engine operating characteristic of the internal combustion engine, the second sensor supplying a second sensor signal representing the second characteristic;

a first set of base control maps and a second set of base control maps, each of the first and second sets of base control maps including a first base engine control map and a second base engine control map, each of the first base engine control maps correlating values of the first and second characteristics with values of a first base engine control and each of the second base engine control maps correlating values of the first and second characteristics with values of a second base engine control;

a first set of trim control maps and a second set of trim control maps, the first and second sets of the trim control maps being separate from the first and second sets of the base control maps, each of the first and second sets of trim control maps including a first trim control map and a second trim control map, each of the first trim control maps correlating values of the first and second characteristics with values of a first trim control and each of the second trim control maps correlating values of the first and second characteristics with values of a second trim control;

an engine control unit obtaining from the first and second sets of base control and trim control maps the respective first base engine control, the second base engine control, the first trim control, and the second trim control that are based on the characteristic value, calculating a first engine operating control value based on the obtained values of the first base engine control and the first trim control, and calculating a second engine operating control value based on the obtained values of the second base engine control and the second trim control, the calculated first and second engine operating control values being supplied to the internal combustion engine to vary the engine performance;

a data port operatively coupled to the engine control unit, the data port being adapted to download the first and second sets of base control maps from an external processor and to upload the first and second sets of the trim control maps to the external processor; and a panel operatively coupled with the engine control unit and adapted to interface with the operator, the panel including:

a first switch regulating a map selection signal supplied to the engine control unit, the first switch being adapted to be manipulated by the operator between a first arrangement and a second arrangement, in the first arrangement of the first switch the map selection signal causing the engine control unit to access the first set of base control maps and the first set of trim control maps, and in second arrangement of the first switch the map selection signal causing the engine control unit to access the second set of base control maps and the second set of trim control maps, a second switch regulating a trim signal supplied to the engine control unit, the second switch being adapted to be manipulated by the operator, and the trim signal causing the engine control unit to modify at least one of the first and second trim control values in the set of trim control maps assessed according to the arrangement of the first switch; and a display receiving from the engine control unit an information signal, the information signal being indicated by the display so as to be interpretable by the operator.

18. The control apparatus according to claim 17, wherein the engine control unit processes trim control signals and supplies information signals according to at least one map trim definition selected from a group consisting of:

parceling one of the trim control maps with respect to at least one of the first and second characteristics to enable trimming within a first parcel and to disable trimming within a second parcel, limiting a range of trim control values that can be stored in a trim control map, and parceling one of the trim control maps with respect to at least one of the first and second characteristics to enable the engine control unit to supply the information signal within a first parcel and to disable the engine control unit from supplying the information signal within a second parcel;

and wherein the data port is adapted to download the at least one map trim definition from the external processor.

19. The control apparatus according to claim 17, wherein the panel further comprises:

a third switch regulating a trim defeat signal supplied to the engine control unit, the third switch being adapted to be manipulated by the operator between a first configuration and a second configuration, in the first configuration of the third switch the trim defeat signal causing the engine control unit to calculate the first and second engine operating control values equal to respective ones of the first and second base engine control values modified by respective ones of the first and second trim control values, and in the second configuration of the third switch the trim defeat signal causing the engine control unit to calculate the first and second engine operating control values equal to respective ones of the first and second base engine control values.

20. The control apparatus according to claim 19, wherein the panel comprises a first portion and a second portion, the first portion comprising the first switch, an on/off switch, and the display, and the second portion being detachable with respect to the first part and comprising the second and third switches.

21. The control apparatus according to claim 18, wherein the engine control unit supplies information signals according to at least one map trim definition selected from a group consisting of:

indicating a limit of the range of the trim control values that can be stored in the trim control map, indicating the first characteristic, indicating the second characteristic, and indicating a third characteristic representing the engine performance of the internal combustion engine.

22. The control apparatus according to claim 17, wherein the engine control unit comprises a processor, and the first sensor signal, the second sensor signal, that map selection signal, the trim signal, and the information signal each comprise an electrical signal.

23. A method for allowing an operator to calibrate engine performance relative to first and second operating characteristics of an internal combustion engine, the method comprising:

providing to an engine control unit a set of base control maps and a set of trim control maps, the set of base control maps including a first base engine control map and a second base engine control map, the first base engine control map correlating values of the first and second characteristics with values of a first base engine control, and the second base engine control map correlating values of the first and second characteristics with values of a second base engine control, the set of trim control maps including a first trim control map and a second trim control map, the first trim control map correlating values of the first and second characteristics with values of a first trim control, and the second trim control map correlating values of the first and second characteristics with values of a second trim control, the engine control unit obtaining from the base control and trim control maps the respective first base engine control, second base engine control, first trim control, and second trim control values that are based on the characteristic values, calculating a first engine operating control value based on the obtained values of the first base engine control and the first trim control, and calculating a second engine operating control value based on the obtained values of the second base engine control and the second trim control, the calculated first and second engine operating control values being supplied to the internal combustion engine to vary the engine performance;

modifying with each trim signal change at least two of the first and second trim control values in a corresponding one of the first and second trim control maps, the trim signal being regulated by a first switch adapted to be manipulated by the operator.

24. The method according to claim 23, further comprising:

downloading the set of base control maps from an external processor via a data port operatively coupled to the engine control unit; and uploading the set of trim control maps from the engine control unit via the data port to the external processor.

25. The method according to claim 23, further comprising:

sensing the first and second characteristics with respective first and second sensors.

26. The method according to claim 23, further comprising:

displaying to the operator information about at least one of the engine characteristics of the internal combustion engine and the trim signals.

27. The method according to claim 23, further comprising:

processing trim control signals in the engine control unit and supplying information signals from the engine control unit according to at least one map trim definition selected from a group consisting of:

parceling one of the trim control maps with respect to at least one of the first and second characteristics to enable trimming within a first parcel and to disable trimming within a second parcel, limiting a range of trim control values that can be stored in a trim control map, and parceling one of the trim control maps with respect to at least one of the first and second characteristics to enable the engine control unit to supply the information signal within a first parcel and to disable the engine control unit from supplying the information signal within a second parcel;

and wherein the data port is adapted to download the at least one map trim definition from the external processor.

28. The method according to claim 23, further comprising:

defeating the trim controls with a second switch adapted to be manipulated by the operator between a first configuration and a second configuration, in the first configuration of the second switch the engine control unit calculating the first and second engine operating control values equal to respective ones of the first and second base engine control values modified by respective ones of the first and second trim control values, and in the second configuration of the second switch the engine control unit calculating the first and second engine operating control values equal to respective ones of the first and second base engine control values.

29. An engine controller, comprising:

a single processor having an input and an output;

memory accessible to the processor, wherein the memory contains:

a base engine control table containing a plurality of base map values that correlate to at least one engine operating characteristic to produce a base control value;

a trim control table containing a plurality of trim map values that correlate to the at least one engine operating characteristic to produce a trim value; and instructions; and a switch coupled to the input, whereby the switch varies at least one of the plurality of trim map values when manipulated by the operator;

whereby the instructions, when executed by the processor, cause the processor to:

select a base value from the base engine control table that corresponds to a current level of the engine operating characteristic;

select a trim value from the trim control table that corresponds to the current level of the engine operating characteristic;

calculate a control value based on the base value and the trim value; and provide a signal at the output corresponding to the calculated control value.

30. The engine controller of claim 29, wherein the base engine control table has a range and the trim control table has a range that is a subset of the base engine control table range, such that the trim value has an effect on the control value when the engine operating characteristic is within the trim control table range and the trim value does not have an effect on the control value when the engine operating characteristic is outside the trim control table range and within the base engine control table range.

31. The engine controller of claim 29, wherein the switch varies at least two trim values in the trim control table.

32. The engine controller of claim 31, wherein the switch varies all trim values in the trim control table.

33. An engine controller comprising:

a processor;

a first input coupled to the processor;

a second input coupled to the processor;

an output coupled to the processor;

memory accessible to the processor, wherein the memory contains:

a base engine control table containing a plurality of base map values that correlate to at least one engine operating characteristic to produce a base control value;

a trim control table containing a plurality of trim map values that correlate to the at least one engine operating characteristic to produce a trim value; and instructions;

a trim switch coupled to the first input that varies at least one of the plurality of trim map values when manipulated by an operator; and a trim defeat switch coupled to the second input that disables the trim control table when the trim defeat switch is in a disable position such that the trim control table has no effect on a signal incident at the output and enables the trim control table when the trim defeat switch is in an enable position such that the trim control table has an effect on the signal incident at the output.

34. The method of claim 33, wherein when the trim control table is disabled, the processor:

selects a base value from the base engine control table that corresponds to the current level of the engine operating characteristic;

calculates a control value based on the selected base value; and provides a signal at the output corresponding to the calculated control value.

35. The method of claim 33, wherein when the trim control table is enabled, the processor:

selects a base value from the base engine control table that corresponds to the current level of the engine operating characteristic;

selects a trim value from the trim control table that corresponds to the current level of the engine operating characteristic;

calculates a control value based on the base value and the trim value; and provides a signal at the output corresponding to the calculated control value.

36. The method of claim 33, wherein when the trim defeat switch is disabled, the processor does not recognize adjustments made at the trim switch.

37. The method of claim 33, wherein when the trim defeat switch is enabled, the processor recognizes adjustments made at the trim switch.

38. An engine controller comprising:

a processor;

a first input coupled to the processor;

a second input coupled to the processor;

an output coupled to the processor;

memory accessible to the processor, wherein the memory contains:

a first base engine control table containing a plurality of first base map values that correlate to at least one engine operating characteristic to produce a base control value;

a first trim control table containing a plurality of first trim map values that correlate to the at least one engine operating characteristic to produce a trim value;

a second base engine control table containing a plurality of second base map values that vary from the first base map values and that correlate to the at least one engine operating characteristic to produce a base control value;

a second trim control table containing a plurality of second trim map values that vary from the first trim map values and that correlate to the at least one engine operating characteristic to produce a trim value; and instructions;

a trim switch coupled to the first input that varies at least one of the trim map values when manipulated by an operator; and a map set selection switch coupled to the second input that selects the base control value of the first base engine control table and the trim value of the first trim control table that correspond to a current level of the engine operating characteristic in a first position and that selects the base control value of the second base engine control table and the trim value of the second trim control table that correspond to the current level of the engine operating characteristic in a second position;

wherein the instructions, when executed by the processor, cause the processor to:

calculate a control value based on the selected base control value and the selected trim value; and provide a signal at the output corresponding to the calculated control value.

* * * * *